US010808491B1

(12) United States Patent
Dirocco

(10) Patent No.: US 10,808,491 B1
(45) Date of Patent: Oct. 20, 2020

(54) PLUG APPARATUS AND METHODS FOR OIL AND GAS WELLBORES

(71) Applicant: FORUM US, INC., Houston, TX (US)

(72) Inventor: Robert Dirocco, Humble, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 16/428,496

(22) Filed: May 31, 2019

(51) Int. Cl.
*E21B 33/128* (2006.01)
*E21B 33/129* (2006.01)
*E21B 33/12* (2006.01)

(52) U.S. Cl.
CPC ..... *E21B 33/128* (2013.01); *E21B 33/12* (2013.01); *E21B 33/1208* (2013.01); *E21B 33/129* (2013.01); *E21B 33/1216* (2013.01)

(58) Field of Classification Search
CPC .. E21B 33/12; E21B 33/1208; E21B 33/1216; E21B 33/128
See application file for complete search history.

(56) References Cited

U.S. PATENT DOCUMENTS

| | | | | |
|---|---|---|---|---|
| 2,230,712 | A | 2/1941 | Bendeler et al. | |
| 3,343,607 | A | 9/1967 | Current | |
| 3,525,393 | A * | 8/1970 | Cobbs | E21B 33/128 166/187 |
| 4,436,150 | A | 3/1984 | Barker | |
| 6,167,963 | B1 | 1/2001 | McMahan et al. | |
| 6,491,116 | B2 | 12/2002 | Berscheidt et al. | |
| 7,735,549 | B1 | 6/2010 | Nish et al. | |
| 7,740,079 | B2 | 6/2010 | Clayton et al. | |
| 8,079,413 | B2 | 12/2011 | Frazier | |
| 8,267,177 | B1 | 9/2012 | Vogel et al. | |
| 9,169,704 | B2 | 10/2015 | Dockweiler et al. | |
| 9,759,034 | B2 | 9/2017 | King et al. | |

(Continued)

FOREIGN PATENT DOCUMENTS

| | | | |
|---|---|---|---|
| WO | 2016028311 | A1 | 2/2016 |
| WO | 2016044597 | A1 | 3/2016 |

(Continued)

OTHER PUBLICATIONS

PCT International Search Report/Written Opinion dated Feb. 26, 2019 for Application No. PCT/US2018/060803.

(Continued)

*Primary Examiner* — Tara Schimpf
(74) *Attorney, Agent, or Firm* — Patterson & Sheridan, L.L.P.

(57) ABSTRACT

Aspects of the present disclosure relate generally to plug apparatus and methods, and components thereof, for oil and gas wellbores. In one implementation, a plug for oil and gas wellbores includes a mandrel, and a gauge ring disposed around the mandrel. The plug also includes a guide shoe disposed around the mandrel. The plug also includes a first cone, a second cone, and a seal element between the first cone and the second cone. The seal element includes an edge that faces the second cone. The seal element is movable between a preset position and a set position, and the movement of the seal element between the preset position and the set position folds the edge of the seal element in a direction from a second end of the seal element towards a first end of the seal element and underneath an outer portion of the seal element.

20 Claims, 7 Drawing Sheets

(56) References Cited

U.S. PATENT DOCUMENTS

| | | | | |
|---|---|---|---|---|
| 9,777,551 | B2 | 10/2017 | Davies et al. | |
| 9,835,003 | B2 | 12/2017 | Harris et al. | |
| 2011/0240295 | A1* | 10/2011 | Porter | E21B 33/12 166/308.1 |
| 2015/0013965 | A1 | 1/2015 | Cox et al. | |
| 2015/0101797 | A1 | 4/2015 | Davies et al. | |
| 2015/0129242 | A1 | 5/2015 | Farquhar | |
| 2015/0300121 | A1 | 10/2015 | Xu | |
| 2016/0138387 | A1 | 5/2016 | Xu et al. | |
| 2016/0305215 | A1 | 10/2016 | Harris et al. | |
| 2016/0312555 | A1 | 10/2016 | Xu et al. | |
| 2016/0376869 | A1 | 12/2016 | Rochen et al. | |
| 2018/0266204 | A1 | 9/2018 | Sherlin | |

FOREIGN PATENT DOCUMENTS

| | | | |
|---|---|---|---|
| WO | 2016210161 | A1 | 12/2016 |
| WO | 2017044298 | A1 | 3/2017 |

OTHER PUBLICATIONS

International Search Report and Written Opinion dated May 28, 2019, corresponding to Application No. PCT/US2018/064973.
Invitation to Pay Additional Fees dated Apr. 3, 2019 for corresponding International Application No. PCT/US2018/064973.

* cited by examiner

PLUG APPARATUS AND METHODS FOR OIL AND GAS WELLBORES

BACKGROUND

Field

Aspects of the present disclosure relate generally to plug apparatus and methods, and components thereof, for oil and gas wellbores.

Description of the Related Art

Plugs for oil and gas wellbores include several components. As an example, a seal assembly for a conventional plug often has five or more components, including at least two extrusion limiters. Such a large number of components involve extra cost and complexity. In addition, having such a large number of components increases the overall length of the plug, which increases the cost of wellbore operations and the amount of time to drill out the plug when the wellbore operation is complete. Therefore, there is a need for a compact and cost-effective plug that simplifies wellbore operations.

SUMMARY

Aspects of the present disclosure relate generally to plug apparatus and methods, and components thereof, for oil and gas wellbores.

In one implementation, a plug for oil and gas wellbores includes a mandrel having an inner surface, an outer surface, a first end and, a second end; and a gauge ring disposed around the mandrel at the first end of the mandrel. The plug also includes a guide shoe disposed around the mandrel at the second end of the mandrel, the guide shoe having a first end and a second end. The plug also includes a first cone disposed around the mandrel between the gauge ring and the guide shoe, a second cone disposed around the mandrel between the gauge ring and the guide shoe, and a seal element disposed around the mandrel between the first cone and the second cone. The seal element includes an inner surface that interfaces with the outer surface of the mandrel, a surface that interfaces with the first cone, the surface defining a first end of the seal element, and an edge that faces the second cone, the edge defining a second end of the seal element. The seal element is movable between a preset position and a set position, and the movement of the seal element between the preset position and the set position folds the edge of the seal element in a direction from the second end of the seal element towards the first end of the seal element and underneath an outer portion of the seal element.

In one implementation, a plug for oil and gas wellbores includes a mandrel having an inner surface, an outer surface, a first end and, a second end; and a gauge ring disposed around the mandrel at the first end of the mandrel. The plug also includes a guide shoe disposed around the mandrel at the second end of the mandrel, the guide shoe having a first end and a second end. The plug also includes a first cone disposed around the mandrel between the gauge ring and the guide shoe, the first cone having a surface. The plug also includes a second cone disposed around the mandrel between the gauge ring and the guide shoe, the second cone having an inner surface, a tapered inner surface, and a tapered outer surface that intersects the tapered inner surface at an apex, the apex defining a first end of the second cone.

The plug also includes a seal element disposed around the mandrel between the first cone and the second cone. The seal element includes an inner surface that interfaces with the outer surface of the mandrel, a surface that interfaces with the surface of the first cone, the surface defining a first end of the seal element, and a first tapered outer surface that interfaces with the tapered inner surface of the second cone, the first tapered outer surface defining a second end of the seal element.

In one implementation, a method of setting a plug in an oil and gas wellbore includes disposing a plug in a wellbore having a casing. The plug includes a mandrel having an inner surface, an outer surface, a first end and, a second end; and a gauge ring disposed around the mandrel at the first end of the mandrel. The plug also includes a guide shoe disposed around the mandrel at the second end of the mandrel, the guide shoe having a first end and a second end; and a first cone disposed around the mandrel between the gauge ring and the guide shoe, the first cone having a surface. The plug also includes a second cone disposed around the mandrel between the gauge ring and the guide shoe; and a seal element disposed around the mandrel between the first cone and the second cone, the seal element having a first end, a second end, and an edge. The method also includes applying a setting force to the plug. The applying the setting force includes folding the edge of the seal element in a direction from the second end of the seal element towards the first end of the seal element and underneath an outer portion of the seal element.

BRIEF DESCRIPTION OF THE DRAWINGS

So that the manner in which the above recited features of the disclosure can be understood in detail, a more particular description of the disclosure, briefly summarized above, may be had by reference to implementations, some of which are illustrated in the appended drawings. It is to be noted, however, that the appended drawings illustrate only common implementations of this disclosure and are therefore not to be considered limiting of its scope, for the disclosure may admit to other equally effective implementations.

Figure 1A:
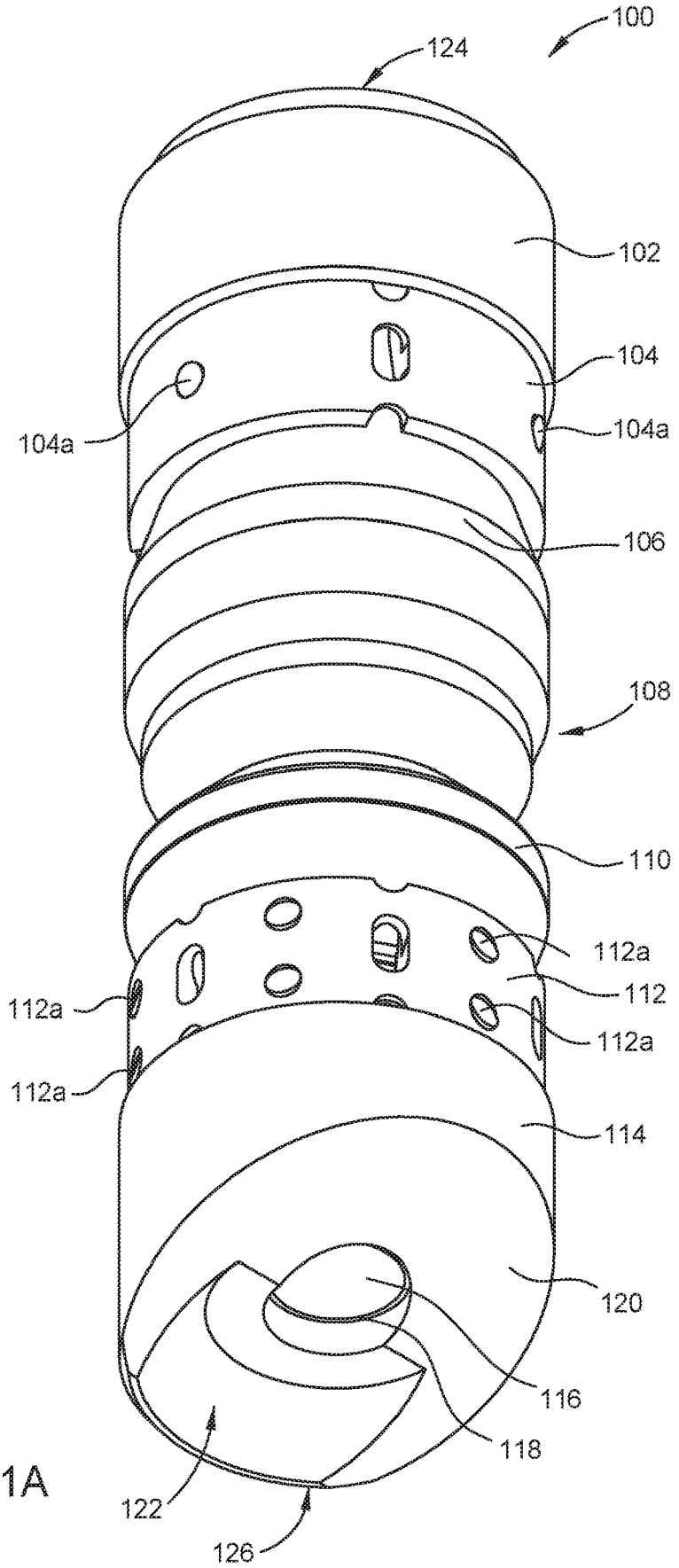
FIG. 1A illustrates a schematic isometric front view of a plug for oil and gas wellbores, according to one implementation.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

Aspects of the present disclosure relate generally to plug apparatus and methods, and components thereof, for oil and gas wellbores.

FIG. 1A illustrates a schematic isometric front view of a plug 100 for oil and gas wellbores, according to one implementation. The plug 100 may be a frac plug or a bridge plug. The plug 100 includes a gauge ring 102 defining an upper end 124 of the plug 100, and a first slip set 104 disposed below the gauge ring 102 that interfaces with the gauge ring 102. The first slip set 104 includes one or more optional grip elements 104*a* that grip an inner surface of a casing disposed in an oil and gas wellbore when the plug 100 is set in the wellbore. The first slip set 104 is an upper slip set. A first cone 106 is disposed below the first slip set 104 and interfaces with the first slip set 104. The first cone 106 is an upper cone. A seal element 108 is disposed below the first cone 106 and interfaces with the first cone 106. A second cone 110 is disposed below the seal element 108 and interfaces with the seal element 108. The second cone 110 is a lower cone. The plug 100 includes a second slip set 112 disposed below the second cone 110 that interfaces with the second cone 110. The second slip set 112 is a lower slip set. The second slip set 112 includes one or more optional grip elements 112*a* that grip an inner surface of a casing disposed in an oil and gas wellbore when the plug 100 is set in the wellbore.

The plug 100 includes a guide shoe 114 disposed below the second slip set 112 that interfaces with the second slip set 112. The guide shoe 114 includes a central bore 116 formed therethrough that is configured to receive a portion of a setting tool (illustrated in FIG. 2A). The guide shoe 114 also includes an inner shoulder 118, a tapered surface 120, and a recess 122 formed in the tapered surface 120. The tapered surface 120 is a tapered lower surface. The guide shoe 114 defines a lower end 126 of the plug 100. The first slip set 104, the first cone 106, the seal element 108, the second cone 110, and the second slip set 112 are disposed between the gauge ring 102 and the guide shoe 114.

Figure 1B:
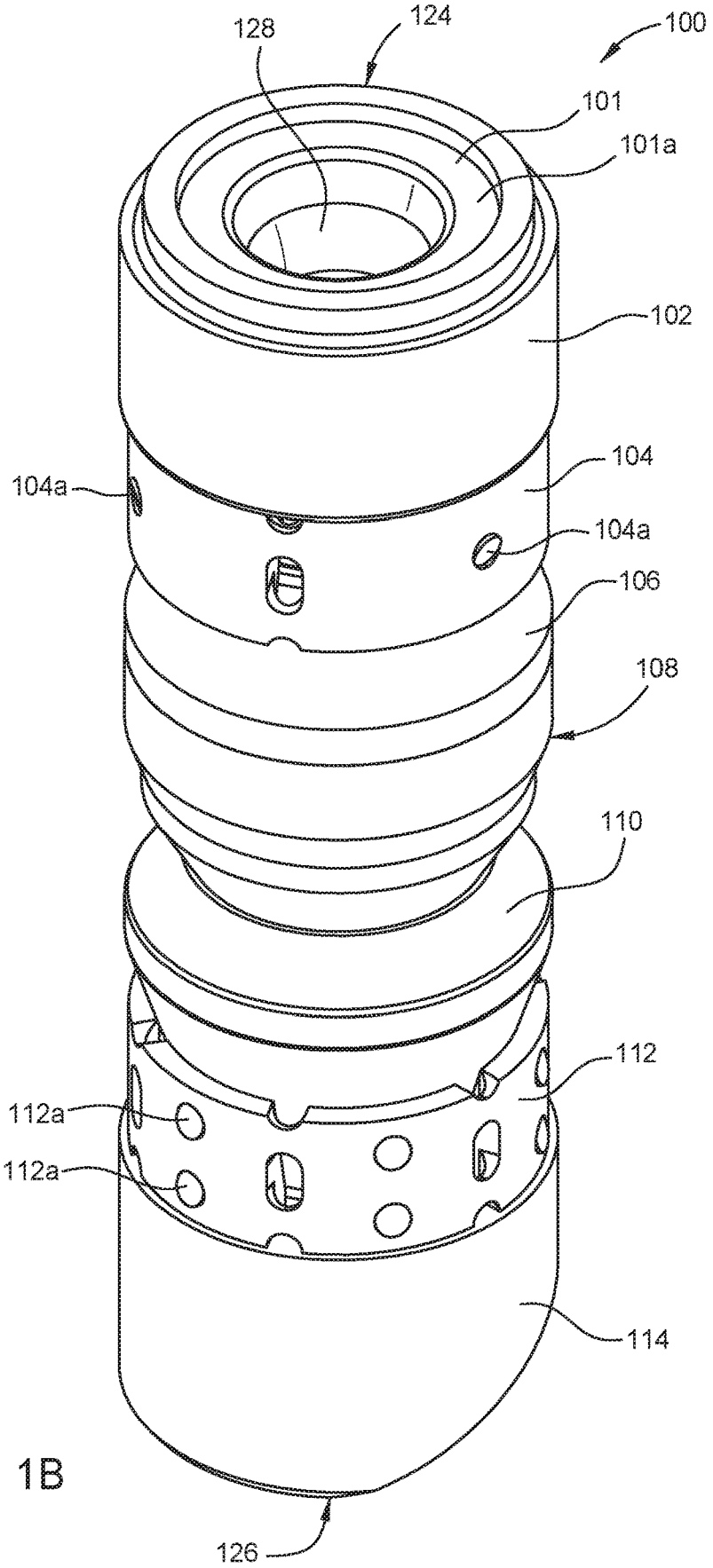
FIG. 1B is a schematic isometric back view of the plug illustrated in FIG. 1A, according to one implementation.

FIG. 1B is a schematic isometric back view of the plug 100 illustrated in FIG. 1A, according to one implementation. The plug 100 includes a mandrel 101 and the gauge ring 102 is disposed around the mandrel 101 at a first end 101*a* of the mandrel 101. The first end 101*a* is an upper end of the mandrel 101. The mandrel 101 includes a ball seat 128.

Figure 2A:
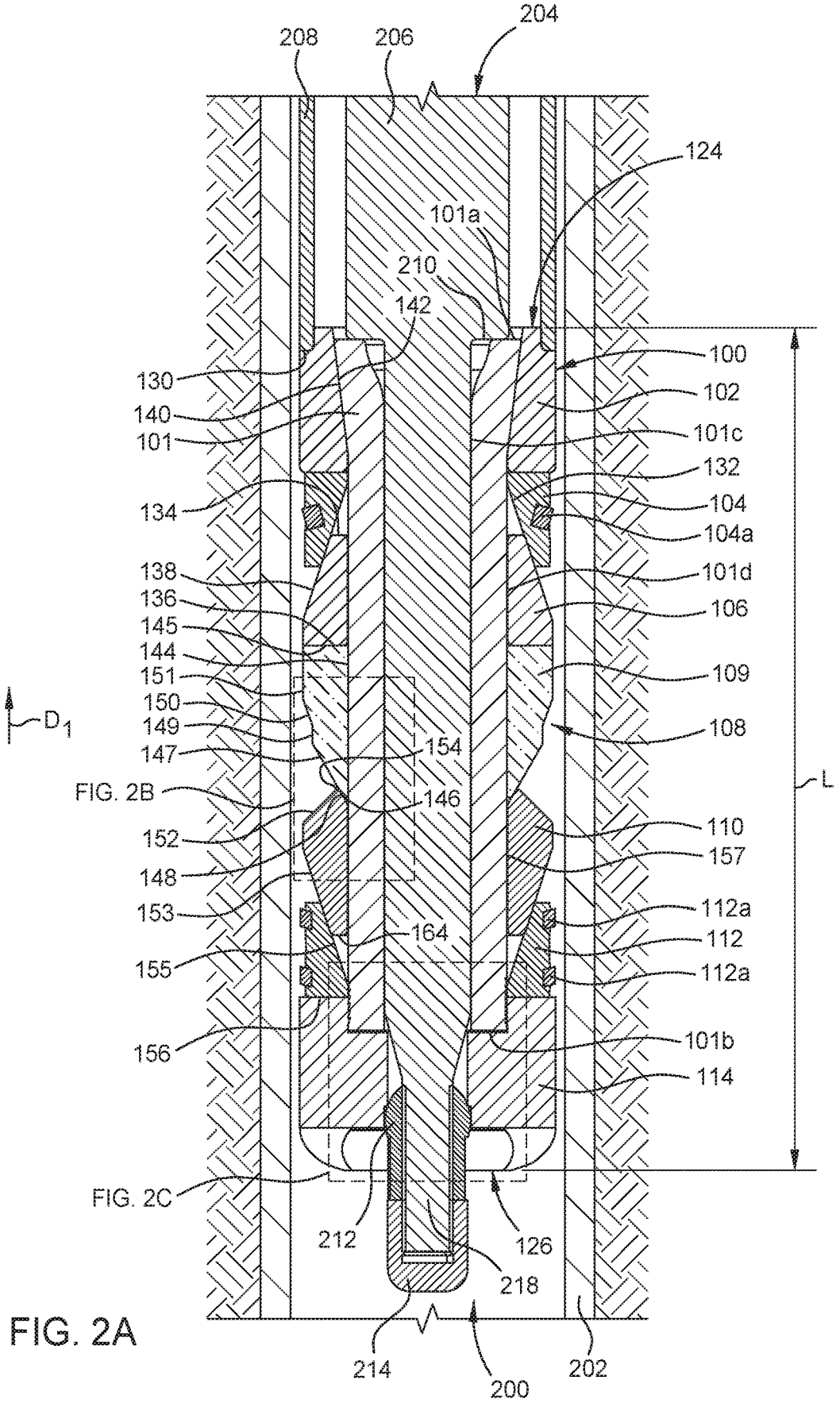
FIG. 2A is a schematic cross sectional view of the plug illustrated in FIGS. 1A and 1B disposed in an oil and gas wellbore in a preset position, according to one implementation.
Figure 2B:
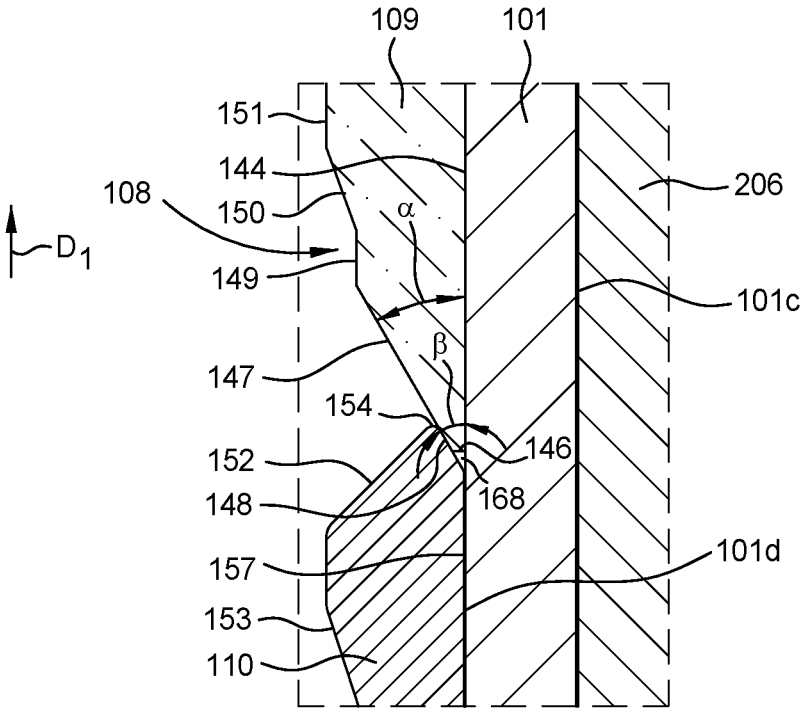
FIG. 2B is an enlarged view of a portion of the plug illustrated in FIG. 2A, according to one implementation.

FIG. 2A is a schematic cross sectional view of the plug 100 illustrated in FIGS. 1A and 1B disposed in an oil and gas wellbore 200 in a preset position, according to one implementation. FIG. 2B is an enlarged view of the plug 100 illustrated in FIG. 2A, according to one implementation. In reference to FIGS. 2A and 2B, the wellbore 200 includes a casing 202.

FIG. 2A depicts the plug 100 in a preset position. The upper end 124 of the plug 100 and the lower end 126 of the plug 100 define a plug length L. The plug length L is less than 15 inches in the preset position. The plug length L allows for a shorter plug 100 relative to other configurations, which allows cost savings and less time for drilling out the plug 100 from the wellbore 200. The mandrel 101 includes the first end 101*a*, a second end 101*b*, an inner surface 101*c*, and an outer surface 101*d*. The second end 101*b* is a lower end of the mandrel 101. The gauge ring 102 is disposed around the mandrel 101 at the first end 101*a* of the mandrel 101. The gauge ring 102 includes an upper shoulder 130. The gauge ring 102 includes a tapered inner surface 140 that interfaces with a tapered outer surface 142 of the mandrel 101. The first slip set 104 is disposed around the mandrel 101 between the gauge ring 102 and the first cone 106. The first slip set 104 includes a tapered inner surface 132.

The first cone 106 is disposed around the mandrel 101 and between the first slip set 104 and the seal element 108. The first cone 106 includes a first end surface 134, a second end surface 136, and a tapered outer surface 138. The first end surface 134 is an upper surface, the second end surface 136 is a lower surface, and the tapered outer surface 138 interfaces with the tapered inner surface 132 of the first slip set 104.

The seal element 108 is disposed around the mandrel 101 and between the first cone 106 and the second cone 110. The second cone 110 is disposed around the mandrel 101 and between the seal element 108 and the second slip set 112. In one example, the seal element 108 is a single body 109. The seal element 108 includes an inner surface 144 that interfaces with the outer surface 101*d* of the mandrel 101 and an end surface 145 that interfaces with the second end surface 136 of the first cone 106. In the preset position, the inner surface 144 of the seal element 108 contacts the outer surface 101*d* of the mandrel 101.

The end surface 145 defines a first end of the seal element 108. The end surface 145 is an upper end surface of the seal element 108 that defines an upper end of the seal element 108. The seal element 108 includes an edge 146 disposed at an end of the seal element 108 that is nearest to the second cone 110. The edge 146 faces the second cone 110. In one example, a gap 168 is disposed between the edge 146 and the second cone 110. In one example, the edge 146 interfaces with the second cone 110. The edge 146 defines a second end of the seal element 108. The second end defined by the edge 146 is a lower end of the seal element 108. The edge 146 is defined at least partially by a first tapered outer surface 147 that interfaces with a tapered inner surface 148 of the second cone 110. The seal element 108 includes a first flat outer surface 149 disposed above the first tapered outer surface 147, and a second tapered outer surface 150 disposed above the first flat outer surface 149. The first flat outer surface 149 defines a first outer diameter of the seal element 108.

The seal element 108 includes a second flat outer surface 151 disposed above the second tapered outer surface 150. The second flat outer surface 151 defines a second outer diameter of the seal element. The second outer diameter defined by the second flat outer surface 151 is larger than the first outer diameter defined by the first flat outer surface 149. In one example, the second flat outer surface 151 is disposed at the first end defined by the end surface 145, and the first flat outer surface 149 and the second tapered outer surface 150 are each disposed between the first tapered outer surface 147 and the second flat outer surface 151.

The seal element 108 is illustrated in a preset position in FIG. 2A. The seal element 108 is made from a compressible material, for example an elastomeric material, such as a rubber material.

The second cone 110 is disposed between the seal element 108 and the second slip set 112. The second cone 110 includes the tapered inner surface 148 that interfaces with the first tapered outer surface 147 of the seal element 108, a first tapered outer surface 152, and a second tapered outer surface 153. The first tapered outer surface 152 intersects the tapered inner surface 148 at an apex 154 of the second cone 110. The apex 154 defines a first end of the second cone 110.

The apex 154 is an edge. The first end is an upper end of the second cone 110. The second cone 110 includes an inner surface 157 that interfaces with the outer surface 101*d* of the mandrel 101. The second tapered outer surface 153 intersects an end face 164 of the second cone 110. The end face 164 defines a second end of the second cone 110. The second end defined by the end face 164 is a lower end of the second cone 110.

As illustrated in FIG. 2B, the first tapered outer surface 147 of the seal element 108 defines a first taper angle α relative to the inner surface 144 of the seal element 108. The tapered inner surface 148 of the second cone 110 defines a second taper angle β relative to the inner surface 157 of the second cone 110. The first taper angle α is equal to the second taper angle β. The first tapered outer surface 147 of the seal element 108 and the tapered inner surface 148 of the second cone 110 taper radially outwardly and away from the outer surface 101*d* of the mandrel 101, in a direction $D_1$ from the lower end 126 of the plug 100 towards the upper end 124 of the plug 100. The first tapered outer surface 152 of the second cone 110 tapers radially inwardly and towards the outer surface 101*d* of the mandrel 101, in a direction $D_1$ from the lower end 126 of the plug 100 towards the upper end 124 of the plug 100. The direction $D_1$ is an upward direction. The direction $D_1$ is in a direction from the second end of the seal element 108 towards the first end of the seal element 108.

The second slip set 112 is disposed between the second cone 110 and the guide shoe 114. The second slip set 112 includes a tapered inner surface 155 that interfaces with the second tapered outer surface 153 of the second cone 110. 110. The guide shoe 114 includes a first end surface 156 that defines a first end of the guide shoe 114 and a tapered surface 120 (shown in FIG. 1A) that defines a second end of the guide shoe 114. In one example, the first end defined by the first end surface 156 is an upper end of the guide shoe 114 and the second end defined by the tapered surface 120 is a lower end of the guide shoe 114. The lower end of the guide shoe 114 defines the lower end 126 of the plug 100.

A setting tool 204 is disposed to set the plug 100 in the wellbore 200 by moving the components of the plug 100 from the respective preset positions to the respective set positions (as described for FIGS. 2D and 2E below). The setting tool 204 includes a tension mandrel 206 and a setting sleeve 208. The setting sleeve 208 interfaces with the upper shoulder 130 formed in the gauge ring 102. The tension mandrel 206 includes a shoulder 210 that interfaces with the first end 101*a* of the mandrel 101 of the plug 100. The setting tool 204 includes a shear ball 212 and a cap 214 disposed on an end portion 218 of the tension mandrel 206.

Figure 2C:
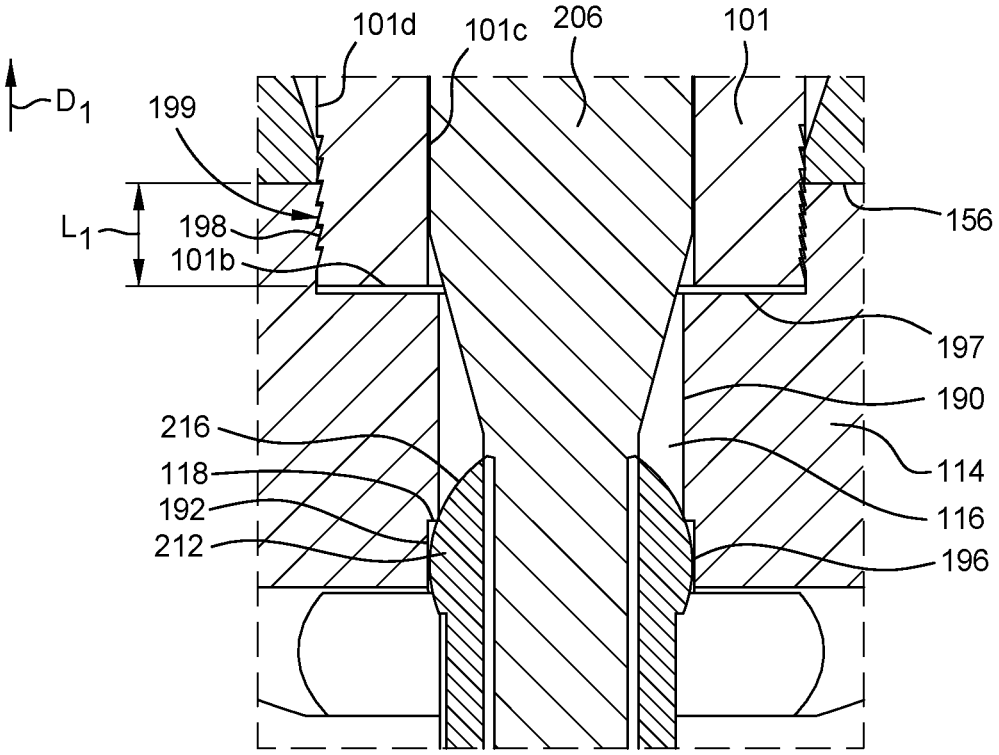
FIG. 2C is an enlarged view of a portion of the plug and setting tool illustrated in FIG. 2A, according to one implementation.

FIG. 2C is an enlarged view of the plug 100 and setting tool 204 illustrated in FIG. 2A, according to one implementation. The guide shoe 114 includes the central bore 116 disposed therethrough, defining a first inner surface 190 of the guide shoe 114. A recess 192 is formed in the first inner surface 190, defining the inner shoulder 118 and a second inner surface 196 of the guide shoe 114. A rounded outer surface 216 of the shear ball 212 interfaces with the inner shoulder 118 of the guide shoe 114 such that when the tension mandrel 206 pulls upwards in the direction $D_1$, a setting force is applied to the guide shoe 114 upwards in the direction $D_1$ to move the components of the plug 100 from the respective preset positions to the respective set positions. The setting sleeve 208 applies a force in a direction that is opposite of the direction $D_1$, resulting in compression of the seal element 108.

The inner shoulder 118 of the guide shoe 114 is configured to deform at a predetermined setting force value, after the plug 100 is in the set position, to allow the shear ball 212 to pass through the guide shoe 114 and be pulled upwards out of the plug 100. The first inner surface 190 of the guide shoe 114 defines a shoe inner diameter of the guide shoe 114. The inner surface 101*c* of the mandrel 101 defines a mandrel inner diameter of the mandrel 101. The mandrel inner diameter of the mandrel 101 defined by the inner surface 101*c* is larger than the shoe inner diameter of the guide shoe 114 defined by the first inner surface 190 to allow the shear ball 212 and the tension mandrel 206 to pass upwards through the mandrel 101 and out of the plug 100.

The guide shoe 114 includes an upper shoulder 197 and an upper inner surface 198 defined by a recess formed in the first end surface 156 of the guide shoe 114. The upper inner surface 198 interfaces with the outer surface 101*d* of the mandrel 101. An interfacing portion 199 between the guide shoe 114 and the mandrel 101 defines an interface length $L_1$. Aspects of the present disclosure allow for an interface length $L_1$ that is less than 1 inch. In one embodiment, which can be combined with other embodiments, the interface length $L_1$ is 0.625 inches. An interface length $L_1$ of less than 1 inch results in a decreased length of the plug 100, along with cost and weights savings.

In FIGS. 2A-2C, the plug 100, the gauge ring 102, the first slip set 104, the first cone 106, the seal element 108, the second cone 110, the second slip set 112, and the guide shoe 114 are shown in the respective preset positions. Each of the plug 100, the gauge ring 102, the first slip set 104, the first cone 106, the seal element 108, the second cone 110, the second slip set 112, and the guide shoe 114 is movable from the respective preset position to a respective set position.

Figure 2D:
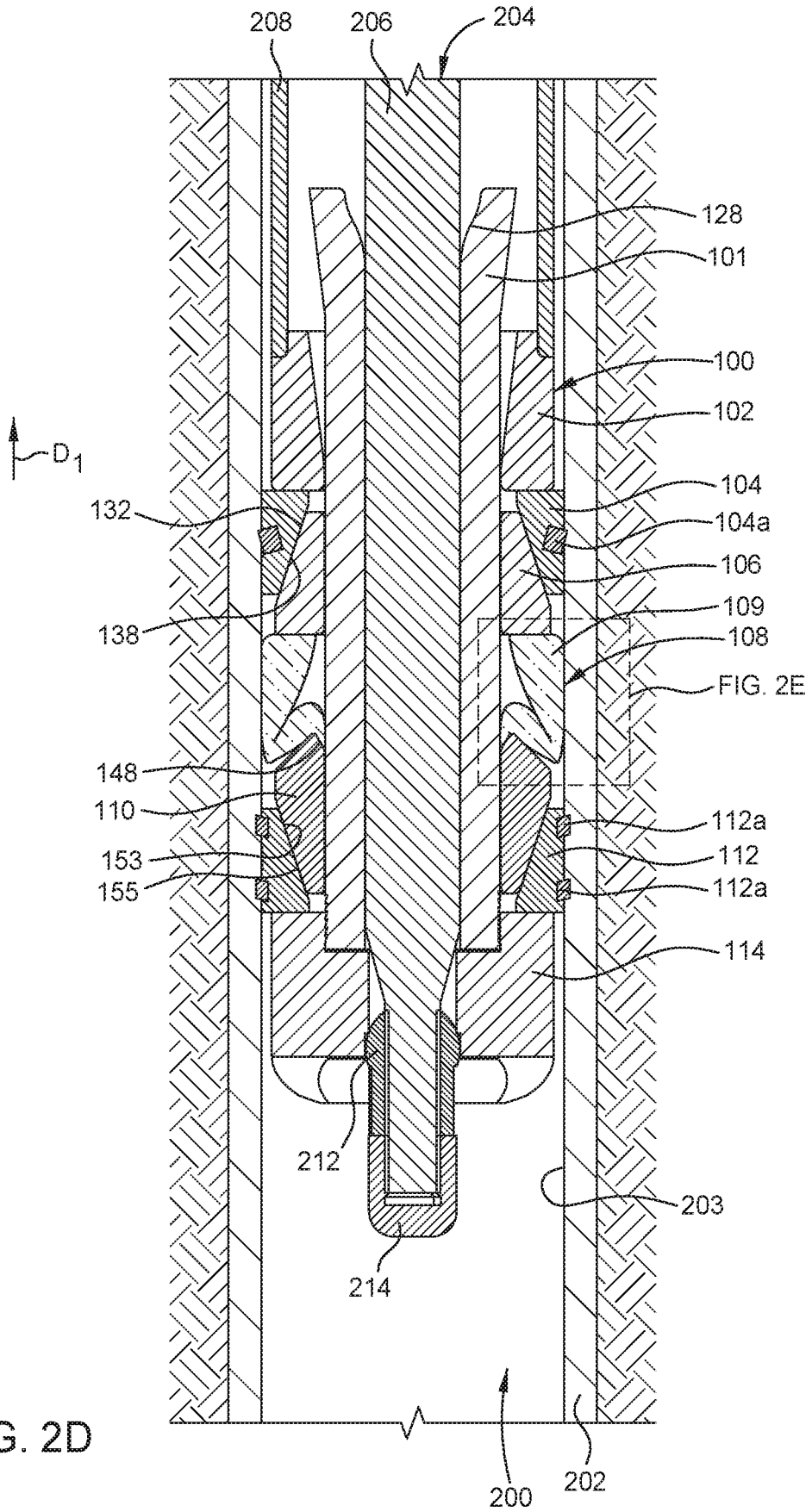
FIG. 2D is a schematic cross sectional view of the plug illustrated in FIGS. 1A and 1B disposed in an oil and gas wellbore in a set position, according to one implementation.

FIG. 2D is a schematic cross sectional view of the plug 100 illustrated in FIGS. 1A and 1B disposed in an oil and gas wellbore 200 in a set position, according to one implementation. In response to a setting force applied by the tension mandrel 206 in the direction $D_1$, and in response to the setting sleeve 208 interfacing with the gauge ring 102, the plug 100 has moved from the preset position to a set position. In moving from a preset position to a set position, the guide shoe 114 has moved upwards in the direction $D_1$. In moving from a preset position to a set position, the second slip set 112 has moved upwards and radially outwards by sliding the tapered inner surface 155 along the second tapered outer surface 153 of the second cone 110. In the set position, the grip elements 112*a* on an outer surface of the second slip set 112 engage and grip an inner surface 203 of the casing 202 in the wellbore 200.

In moving from a preset position to a set position, the second cone 110 may move upwards in the direction $D_1$. In moving from a preset position to a set position, the first slip set 104 moves radially outwardly towards the casing 202 by sliding the tapered inner surface 132 of the first slip set 104 along the tapered outer surface 138 of the first cone 106. In moving from a preset position to a set position, the first cone 106 may apply a force to the first slip set 104 upwardly in a direction $D_1$ while the gauge ring 102 may apply a force to the first slip set 104 in a direction opposite of the direction $D_1$. In the set position, the grip elements 104*a* on an outer surface of the first slip set 104 engage and grip the inner surface 203 of the casing 202 in the wellbore 200. In moving from a preset position to a set position, the mandrel 101 may move upwards in the direction $D_1$ and may move relative to the gauge ring 102.

Figure 2E:
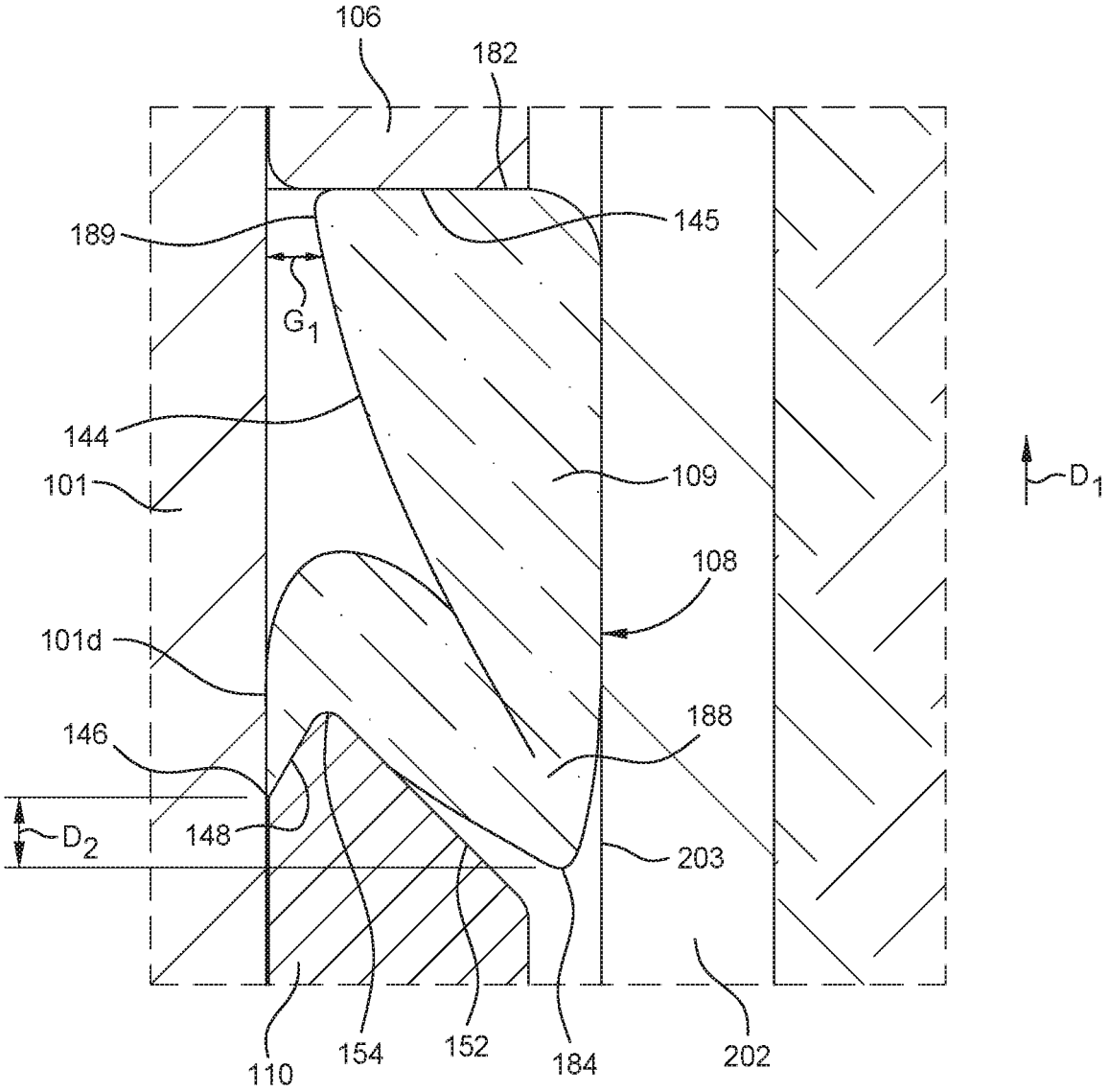
FIG. 2E is an enlarged view of a portion of the plug illustrated in FIG. 2D, according to one implementation.

FIG. 2E is an enlarged view of the plug 100 illustrated in FIG. 2D, according to one implementation. In moving from a preset position to a set position, the tapered inner surface 148 of the second cone 110 pushes into the first tapered outer surface 147 of the seal element 108 to fold the edge 146 of the seal element 108 in the direction $D_1$ and underneath an outer portion 188 of the seal element 108. In the set position, the seal element 108 includes a first end 182 and a second end 184. The first end 182 is an upper end and the second end 184 is a lower end. In the set position, a portion 189 of the inner surface 144 of the seal element 108 is disposed at a gap $G_1$ from the outer surface 101*d* of the mandrel 101. In one example, the portion 189 disposed at the gap $G_1$ is disposed at the first end 182 of the seal element 108 defined by the end surface 145. In on example, the portion 189 disposed at the gap $G_1$ is between the first end 182 and the second end 184, and a portion of the seal element 108 at the first end 182 contacts the outer surface 101*d* of the mandrel 101.

In the set position, the seal element 108 contacts both the outer surface 101*d* of the mandrel and the inner surface 203 of the casing 202, forming a seal between the mandrel 101 and the casing 202. In the set position, the edge 146 of the seal element 108 is disposed between the first end 182 and the second end 184 of the seal element 108. In one example, the edge 146 is disposed above the second end 184 at a distance $D_2$ from the second end 184 of the seal element 108. In moving from the preset position to the set position, a portion of the seal element 108, such as outer portion 188, moves radially outward and along the first tapered outer surface 152 of the second cone 110. In moving from the preset position to the set position, a portion of the seal element 108, such as outer portion 188, moves between the first tapered outer surface 152 of the second cone 110 and the inner surface 203 of the casing 202.

Figure 3:
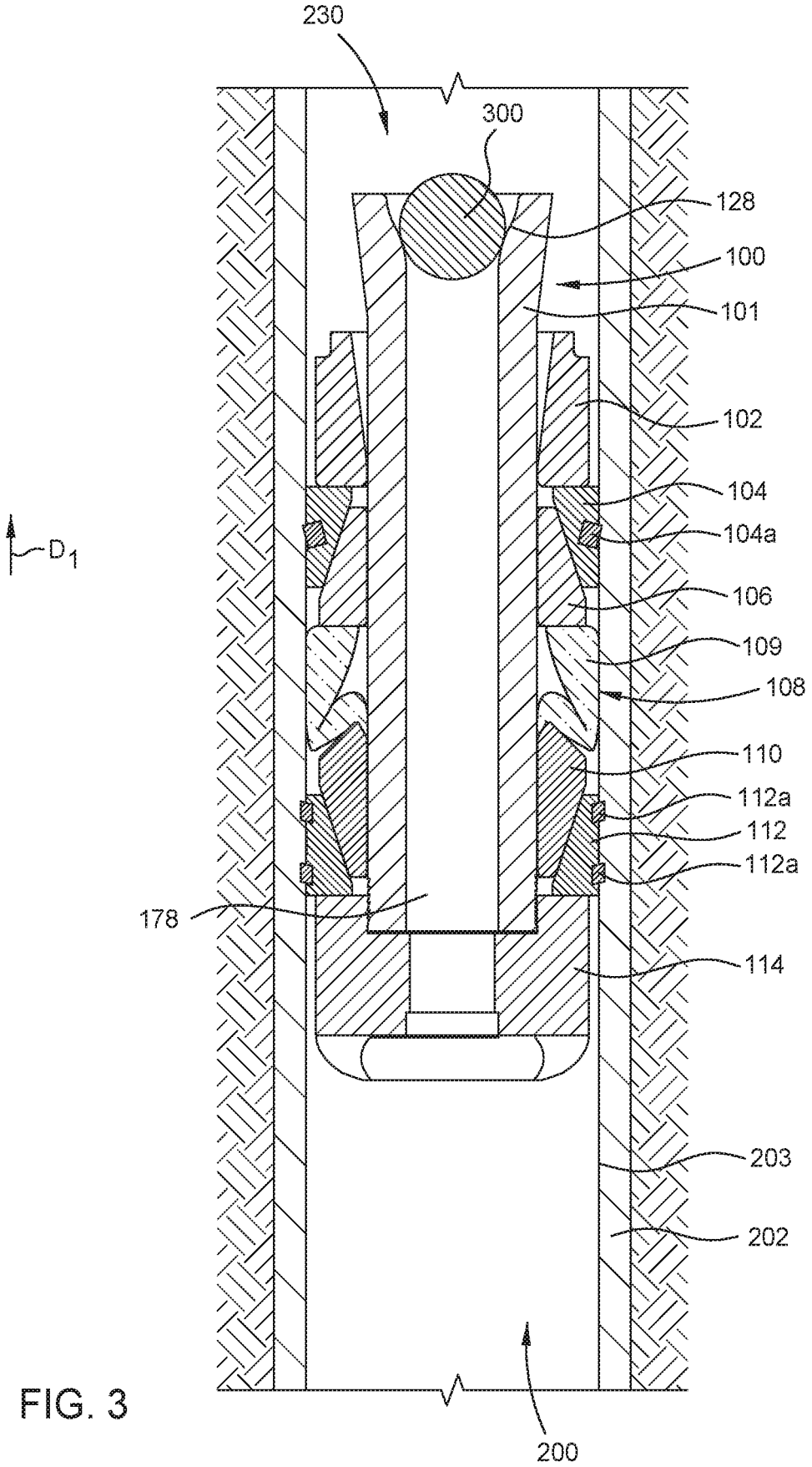
FIG. 3 is a schematic cross sectional view of a ball and the plug illustrated in FIGS. 1A and 1B disposed in an oil and gas wellbore in a set position, according to one implementation.

FIG. 3 is a schematic cross sectional view of a ball 300 and the plug 100 illustrated in FIGS. 1A and 1B disposed in an oil and gas wellbore 200 in a set position, according to one implementation. The setting tool 204 has been removed from the wellbore 200. A ball 300 is seated in the ball seat 128 of the mandrel 101, at least partially blocking a central opening 178 of the mandrel 101. The ball 300 may allow for a region of the wellbore 200, such as the region 230 above the wellbore 200, to be stimulated with stimulation pressure by pumping fluid into the wellbore 200. As an example, the plug 100 is a frac plug, and the wellbore 200 above the ball 300 and plug 100 is stimulated with stimulation pressure during fracing operations.

Aspects of the present disclosure, such as folding the edge 146 of the seal element 108 in the direction $D_1$ and underneath an outer portion 188 of the seal element 108, directs most of a force applied to the plug 100 radially outwardly and towards the casing 202. Hence, more of the applied force (such as a setting force or a stimulation force) is translated to sealing pressure to seal the wellbore 200, as compared to other plug configurations. The plug 100 can generate a sealing pressure as high as 17,000 psi with a setting force as small as 25,000 lbs. The plug 100 can withstand larger stimulation pressures, such as pressures applied during fracing operations, than other configurations.

Aspects of the present disclosure also allow for components of the plug 100 to be made from nonmetallic materials due to the force interactions of components the plug 100. As an example, the mandrel 101, the second cone 110, the second slip set 112, and/or the grip elements 112*a* may be made from a polymeric material due to the relatively low forces that act on these components when the plug 100 moves from a preset position to a set position and/or when stimulation pressure is applied to the wellbore 200.

In one example, one or more of the mandrel 101, the second cone 110, the second slip set 112, and/or the grip elements 112*a* are made from a polymeric material. In one example, the polymeric material includes a plastic material. In one example, the polymeric material includes a hydrocarbon compound. In one example, the polymeric material includes one or more of polyethylene terephthalate, polyethylene, polyvinyl chloride, polypropylene, polystyrene, polylactic acid, and/or polycarbonate. Such materials can be more cost-effective than metal materials, resulting in a simpler and more cost-effective plug 100.

The plug 100 achieves these benefits with a seal element 108 made from a single component, as compared to other seal devices that have multiple components, such as extrusion limiters. The plug 100 results in cost savings, time savings, and a relatively simple design. The seal element 108 configuration can reduce the cost of plugs by up to 25% as compared to other seal configurations. The seal element 108 also reduces the overall length of the plug 100, thereby reducing the amount of time needed to drill out the plug 100 from a wellbore 200.

Benefits of the present disclosure include directing forces applied to a plug radially outwardly to translate to sealing pressure; generating relatively more sealing pressure with relatively less setting force; having plug components made from nonmetallic materials; cost savings; less time to drill out a plug; and a simpler plug design. Aspects of the present disclosure include folding an edge of a seal element in a direction from a second end to a first end and underneath an outer portion of the seal element; a second cone having a tapered inner surface and a tapered outer surface that intersects the tapered inner surface at an apex, the apex defining a first end of the second cone; and a seal element having a surface that interfaces with a surface of a first cone, the surface defining a first end of the seal element, and a first tapered outer surface that interfaces with the tapered inner surface of the second cone, the first tapered outer surface defining a second end of the seal element. It is contemplated that one or more of these aspects disclosed herein may be combined. Moreover, it is contemplated that one or more of these aspects may include some or all of the aforementioned benefits.

While the foregoing is directed to embodiments of the present disclosure, other and further embodiments of the disclosure may be devised without departing from the basic scope thereof. The present disclosure also contemplates that one or more aspects of the embodiments described herein may be substituted in for one or more of the other aspects described. The scope of the disclosure is determined by the claims that follow.

The invention claimed is:

1. A plug for oil and gas wellbores, comprising:

a mandrel having an inner surface, an outer surface, a first end, and a second end;

a gauge ring disposed around the mandrel at the first end of the mandrel;

a guide shoe disposed around the mandrel at the second end of the mandrel, the guide shoe having a first end and a second end;

a first cone disposed around the mandrel between the gauge ring and the guide shoe;

a second cone disposed around the mandrel between the gauge ring and the guide shoe, the second cone having an inner surface comprising a tapered surface disposed at a taper angle, and a tapered outer surface that intersects the tapered surface of the inner surface at an apex, the apex defining a first end of the second cone; and a seal element disposed around the mandrel between the first cone and the second cone, the seal element comprising:

an inner surface that interfaces with the outer surface of the mandrel;

a surface that interfaces with the first cone, the surface defining a first end of the seal element; and an edge that faces the second cone, the edge defining a second end of the seal element, the seal element being movable between a preset position and a set position, wherein a movement of the seal element between the preset position and the set position folds the edge of the seal element in a direction from the second end of the seal element towards the first end of the seal element and underneath an outer portion of the seal element.

2. The plug of claim 1, wherein the seal element further comprises an inner surface, and a portion of the inner surface is in contact with the outer surface of the mandrel in the preset position, and the portion of the inner surface of the seal element is disposed at a gap from the outer surface of the mandrel in the set position.

3. The plug of claim 2, wherein the portion of the inner surface of the seal element is disposed at the first end of the seal element.

4. The plug of claim 1, wherein the plug has a length defined between the first end of the mandrel and the second end of the guide shoe, and the length is less than 15 inches.

5. The plug of claim 1, wherein a first inner surface of the guide shoe interfaces with the outer surface of the mandrel and defines an interface length that is less than 1 inch.

6. The plug of claim 5, wherein a second inner surface of the guide shoe defines a shoe inner diameter, and the inner surface of the mandrel defines a mandrel inner diameter that is greater than the shoe inner diameter.

7. The plug of claim 1, wherein the mandrel and the second cone each is made from a nonmetallic material.

8. The plug of claim 1, wherein the plug is a frac plug.

9. A plug for oil and gas wellbores, comprising:

a mandrel having an inner surface, an outer surface, a first end and, a second end;

a gauge ring disposed around the mandrel at the first end of the mandrel;

a guide shoe disposed around the mandrel at the second end of the mandrel, the guide shoe having a first end and a second end;

a first cone disposed around the mandrel between the gauge ring and the guide shoe, the first cone having a surface;

a second cone disposed around the mandrel between the gauge ring and the guide shoe, the second cone having an inner surface comprising a tapered surface disposed at a taper angle, and a tapered outer surface that intersects the tapered surface of the inner surface at an apex, the apex defining a first end of the second cone; and a seal element disposed around the mandrel between the first cone and the second cone, the seal element comprising:

an inner surface that interfaces with the outer surface of the mandrel;

a surface that interfaces with the surface of the first cone, the surface defining a first end of the seal element; and a first tapered outer surface that interfaces with the tapered surface of the inner surface of the second cone, the first tapered outer surface defining a second end of the seal element.

10. The plug of claim 9, wherein the seal element further comprises:

a first flat outer surface defining a first outer diameter;

a second tapered outer surface; and a second flat outer surface defining a second outer diameter that is larger than the first outer diameter.

11. The plug of claim 9, wherein each of the second cone and the seal element is movable between a preset position and a set position and the first tapered outer surface of the seal element defines an edge of the seal element, and a movement of the second cone between the preset position and the set position folds the edge of the seal element in a direction from the second end of the seal element towards the first end of the seal element and underneath an outer portion of the seal element.

12. The plug of claim 9, wherein the first tapered outer surface of the seal element and the tapered surface of the inner surface of the second cone taper radially outwardly and away from the outer surface of the mandrel in a direction from the second end of the seal element towards the first end of the seal element.

13. The plug of claim 12, wherein the first tapered outer surface of the seal element defines a first taper angle relative to the inner surface of the seal element, and the tapered surface of the inner surface of the second cone defines a second taper angle relative to the inner surface of the second cone, and the first taper angle is equal to the second taper angle.

14. The plug of claim 12, wherein the tapered outer surface of the second cone tapers radially inwardly and towards the outer surface of the mandrel in the direction from the second end of the seal element towards the first end of the seal element.

15. The plug of claim 9, wherein the plug has a length defined between the first end of the mandrel and the second end of the guide shoe, and the length is less than 15 inches.

16. The plug of claim 9, wherein a first inner surface of the guide shoe interfaces with the outer surface of the mandrel and defines an interface length that is less than 1 inch.

17. The plug of claim 16, wherein a second inner surface of the guide shoe defines a shoe inner diameter, and the inner surface of the mandrel defines a mandrel inner diameter that is greater than the shoe inner diameter.

18. The plug of claim 9, wherein the mandrel and the second cone each is made from a nonmetallic material.

19. A method of setting a plug in an oil and gas wellbore, comprising:

disposing a plug in a wellbore having a casing, the plug comprising:

a mandrel having an inner surface, an outer surface, a first end and, a second end;

a gauge ring disposed around the mandrel at the first end of the mandrel;

a guide shoe disposed around the mandrel at the second end of the mandrel, the guide shoe having a first end and a second end;

a first cone disposed around the mandrel between the gauge ring and the guide shoe, the first cone having a surface;

a second cone disposed around the mandrel between the gauge ring and the guide shoe, the second cone having an inner surface comprising a tapered surface disposed at a taper angle, and a tapered outer surface that intersects the tapered surface of the inner surface at an apex, the apex defining a first end of the second cone; and a seal element disposed around the mandrel between the first cone and the second cone, the seal element having a first end, a second end, and an edge; and applying a setting force to the plug, the applying the setting force comprising:

folding the edge of the seal element in a direction from the second end of the seal element towards the first end of the seal element and underneath an outer portion of the seal element.

20. The method of claim 19, wherein the applying the setting force further comprises pushing the tapered surface of the inner surface of the second cone into a tapered outer surface of the seal element.

* * * * *